US006400337B1

(12) United States Patent
Handelsman

(10) Patent No.: US 6,400,337 B1
(45) Date of Patent: Jun. 4, 2002

(54) THREE DIMENSIONAL POLYGON ANTENNAS

(76) Inventor: Dan Handelsman, 16 Attitash, Chappaqua, NY (US) 10514

( * ) Notice: Subject to any disclaimer, the term of this patent is extended or adjusted under 35 U.S.C. 154(b) by 0 days.

(21) Appl. No.: 09/853,991

(22) Filed: May 11, 2001

(51) Int. Cl.[7] ..... H01Q 21/00
(52) U.S. Cl. ..... 343/867; 343/742
(58) Field of Search ..... 343/741, 742, 343/743, 866, 867, 870

(56) References Cited

U.S. PATENT DOCUMENTS 4,358,769 A * 11/1982 Tada et al. ..... 343/742
5,258,766 A * 11/1993 Murdoch ..... 343/742
6,069,564 A * 5/2000 Hatano et al. ..... 343/742

* cited by examiner

*Primary Examiner*—Don Wong
*Assistant Examiner*—Hoang Nguyen
(74) *Attorney, Agent, or Firm*—Cooper & Dunham LLP

(57) ABSTRACT

A series of antennas with a three-dimensional structure based on the folding back onto themselves of planar multi-loop arrays of more than two elements is provided. In this way, more compact antennas are provided, with improved broadband design capabilities and wider bandwidths, both in impedance and gain. A three-dimensional antenna array comprises a plurality of rectangular full-wave loops arranged in a three-dimensional array, comprising a plurality of radiators, each radiator having two ends, and a plurality of transmission lines, each transmission line connecting a pair of the radiators through a corresponding end of each connected radiator, wherein each of the plurality of radiators is fed from a common feedpoint substantially at a geometric center of the three-dimensional antenna array.

10 Claims, 4 Drawing Sheets

THREE DIMENSIONAL POLYGON ANTENNAS

TECHNICAL FIELD

The present invention relates to three dimensional polygon antenna designs.

BACKGROUND ART

There are various types of antennas which are known in the art. These types include the full-wave (FW) square loop antenna, the rectangle class of antennas (of which the square is a member), the multi-loop antenna, and the large perimeter loop antenna which results from the use of thick wires in its construction.

The basic full-wave (FW) or 1 λ loop element is a known antenna. A four-sided rectangular full-wave (FW) loop antenna can have many shapes, ranging from a folded dipole at one extreme to a 0.5 λ transmission line which is terminated by two minute Hertzian dipole elements at the other extreme. The square variant was the first of this class to be developed.

FIG. 1 illustrates a square full-wave (FW) loop antenna, also known as a Quad loop. In FIG. 1, a square loop is shown that is nominally 1 λ in perimeter, or 0.25 λ per side. The design may be visualized as being comprised of two 0.5 λ dipoles, separated in height by 0.25 λ, with their ends folded down and touching. The antenna may also be visualized as illustrated in FIG. 2, which shows two U-shaped 0.5 λ dipoles with truncated central radiating sections of 0.25 λ and folded ends of 0.125 λ.

Basically, then, rectangle-based antennas are comprised of two short parallel dipole radiating elements with the ends of the dipoles connected to each other by way of a pair of transmission line wires. The square is a unique case which has radiators and transmission line wires of equal size.

Only a single feedpoint is necessary and this port may be located at the center of any of the four sides. The polarization of the antenna depends on whether the feedpoint is placed at the center of a vertical or a horizontal wire. The wire opposite and parallel to the fed wire also radiates, because it carries in-phase and co-directional currents of equal magnitude.

The wires orthogonal to the radiators act as transmission lines, have a 180 degree phase shift at their centers (current minima), and carry currents which are anti-directional; therefore, for all practical purposes, these wires do not radiate. In the case of a square where only one radiating element is fed, the physical transmission line connections between the two radiators are necessary in order to maintain the proper phase relationships in the radiator currents.

In all subsequent discussions of rectangle-based antennas, the radiators will be referred to as including the fed wire and those elements which are parallel to it. "Transmission line wires" will refer to the wires connecting the radiator ends to each other. The sizes of the radiators and transmission line wires are inversely related (i.e., as one lengthens the other must shorten) to maintain the overall loop perimeter somewhere at approximately 1 λ.

The radiation resistance $R_{in}$ of such a square loop is in the order of 120 ohms and is a product of the self resistance $R_{self}$ of each of the truncated dipole radiators and the mutual resistance $R_m$ induced by the parallel radiator. A close approximation of $R_{in}$ for the square or any rectangular-shaped variant of a FW loop may be represented by the formula $R_{in}=2(R_{self}+R_m)$.

These loops are only nominally 1 λ in perimeter. Due to the capacitive reactance induced by the proximity of their high-voltage/low-current points at the centers of their transmission line wires (i.e., the points where the folded back dipole tips touch each other), the feedpoint reactance $X_{in}$ of an antenna consisting of two such folded-down 0.5 λ dipoles is highly negative. In order to resonate ($X_{in}=0$) such an antenna, the sides must be increased in size beyond 0.25 λ and therefore the perimeter beyond 1 λ.

The overall loop perimeter or length per side depends on the thickness of the wire composing the antenna: the greater the diameter of the wire, the greater the negative $X_{in}$ and the greater the perimeter at resonance. With very thick wires (e.g., having diameters exceeding 0.03 λ) the loop perimeter exceeds 1.3 λ.

The bandwidth (BW) for all antennas discussed herein is defined by the standing wave ratio (SWR) 2:1 limits when referenced against $R_{in}$. This is also dependent on the wire thickness since it is a function of the Q-factor; the thicker the wire, the wider the bandwidth.

The square FW loop has broadside radiation from its two radiators, which are in phase and which have equal currents. It has a gain improvement over that of one of its constituent dipoles in the order of slightly more than 1 dB. This is due to the "stacking effect," an aperture overlap between the radiation patterns of the two truncated dipoles separated by 0.25 λ. Depending on the wire thickness, the overall gain of a square FW loop is in the order of 3.1–3.4 dBi.

There are two extremes in the shape of rectangular FW loops. One extreme is the folded dipole (FD), where the two radiators are almost 0.5 λ long and the interconnecting transmission lines are minuscule. The $R_{in}$, derived from the formula above, is in the order of 288 ohms. The gain is that of a simple dipole but there is an improvement in the bandwidth.

The other extreme is that of two minuscule "Hertzian dipole" radiators connected by a 0.5 λ transmission line. The $R_{in}$ approaches 0 ohms while the modeled gain, using Numerical Electronics Code (NEC), exceeds 6 dBi.

In between these two extremes in the shape of a FW loop, there are an infinite number of possible antennas with intermediate properties. The narrower the radiator, the lower the radiation resistance, the greater the gain, and the narrower the bandwidth. The gain is a function of the separation of the radiators. The bandwidth bears a direct relationship to the $R_{in}$. Other, well-known, antennas which function similarly are slot antennas.

Any FW loop can be attached directly to another. If two such loops are conjoined at a common radiator, a planar antenna results, with two equal-sized loops consisting of three radiators, as shown in FIG. 3. Since there are now three radiating elements with equal element separation, there is an increase in gain. NEC modeling of one of maximum gain, at the dimensional extreme of three Hertzian dipole radiators connected via 0.5 λ transmission lines, yields a gain in excess of 7.1 dBi.

These double-loops have properties similar to the simple rectangles of which they are comprised. Their loop perimeters increase with wire diameter, their gain is a function of radiator separation, their radiation resistance is related to the self resistance of the radiators as well as the mutual resistance contributed by the two other parallel radiating wires, and their bandwidth is related to the input resistance.

There is a need for more compact antennas with improved broadband design capabilities and wider bandwidths, both in impedance and gain.

SUMMARY OF INVENTION

The antenna design of the present invention is a three-dimensional (3-D) arrangement of full-wavelength (FW) or 1 λ loops. A major advantage of this antenna design is that it is very amenable to broadband design with a range of operating frequencies or bandwidth (BW) in excess of 3:1. Furthermore, the antenna design is relatively compact, with the maximum dimension being less than that of a half-wave dipole at the lowest frequency. The gain of this antenna design exceeds that of a dipole over the entire bandwidth by 1–1.5 dB. These antennas may be used by themselves or as individual elements in high-gain wideband arrays.

Variants of these antennas may also be designed for use as compact higher gain vertical scanning arrays where the beam pattern may be rotated electronically over a 360 degree azimuth. In addition to the increased forward gain, the other advantage in this type of use is in the very deep nulls off the rear which serve to minimize interference. Other variants, whether horizontally or vertically polarized, may be used for controlled squint of their elevation lobes.

With dimensional changes, these antennas can be designed to attain any feedpoint impedance in the range of 24–300+ ohms. In addition to the 3-D structure, the feed system is critical in achieving these performance objectives. This invention is for the family of 3-D rectangular-loop based antennas and for the feed system.

The present invention in one embodiment provides a three-dimensional antenna array, comprising a plurality of rectangular full-wave loops arranged in a three-dimensional array, comprising a plurality of radiators, each radiator having two ends, and a plurality of transmission lines, each transmission line connecting a pair of the radiators through a corresponding end of each connected radiator, wherein each of the plurality of radiators is fed from a common feedpoint substantially at a geometric center of the three-dimensional antenna array.

The present invention in another embodiment provides a three-dimensional antenna arranged as a cubic triangle, comprising three contiguous full-wave loops arranged vertically to form the cubic triangle, comprising three radiators, each radiator having two ends, and a plurality of transmission lines, each transmission line connecting a corresponding pair of the radiators through a corresponding end of each radiator in the connected pair of radiators, and wherein each of the three radiators is fed from a common feedpoint substantially at a geometric center of the cubic triangle.

The present invention in another embodiment provides a three-dimensional antenna array arranged as a cubic hexagon, comprising a first element having a first group of six radiators arranged in a hexagonal arrangement, and a first plurality of transmission lines, wherein each radiator in the first group of six radiators has two ends, and each transmission line in the first plurality of transmission lines connects a corresponding pair of radiators in the first group of six radiators through a corresponding end of each radiator in the connected pair of radiators; and a second element spaced apart from the first element and having a second group of six radiators arranged in a hexagonal arrangement and a second plurality of transmission lines, wherein each radiator in the second group of six radiators has two ends, and each transmission line in the second plurality of transmission lines connects a corresponding pair of radiators in the second group of six radiators through a corresponding end of each radiator in the connected pair of radiators, wherein a corresponding radiator in each element is fed in phase.

The present invention in another embodiment provides a three-dimensional antenna arranged as a cubic hexagon, comprising a group of six radiators arranged in a hexagonal arrangement, each radiator having two ends; and a plurality of transmission lines, each transmission line connecting a corresponding pair of radiators in the group of six radiators through a corresponding end of each radiator in the connected pair of radiators; wherein each radiator has a corresponding feedline extending to a common feedpoint substantially at a geometric center of the cubic hexagon.

The present invention in another embodiment provides an antenna, comprising a three-dimensional arrangement of full-wavelength loops having a plurality of radiators, each radiator being fed from a common feedpoint substantially at a geometric center of the three-dimensional arrangement.

The radiators and the transmission lines in each of the above embodiments may be orthogonal.

DETAILED DESCRIPTION OF THE INVENTION

Figure 1:
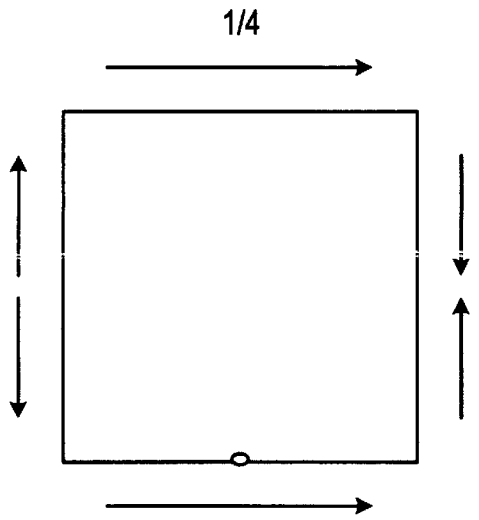
FIG. 1 shows a square loop antenna.
Figure 2:
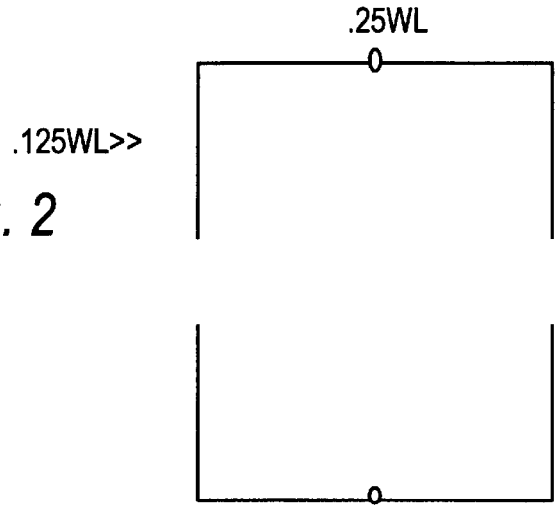
FIG. 2 shows another square loop antenna.
Figure 3:
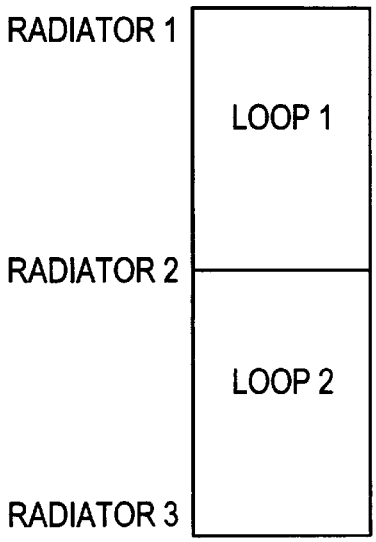
FIG. 3 shows a double-loop antenna.
Figure 4:
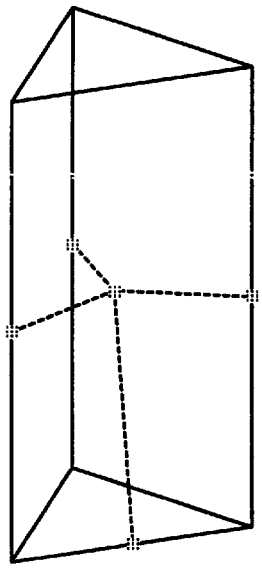
FIG. 4 shows a Cubic Triangle in accordance with one embodiment.

The antenna design of the present invention is novel in that it is a three-dimensional (3-D) arrangement of full-wavelength (FW) or 1 λ loops. These antennas will be referred to hereinafter as "Cubic Polygons," with the simplest being a Cubic Triangle and a more complex model being a Cubic Dodecahedron. FIG. 4 shows the Cubic Triangle, which is discussed in more detail below.

Figure 5:
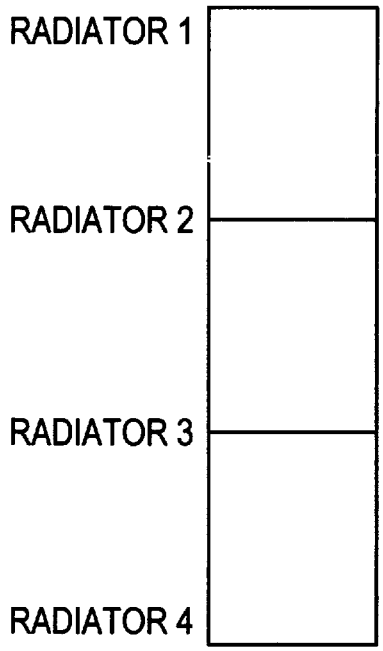
FIG. 5 shows a triple-loop antenna.

The following is novel in that the properties of linearly arranged planar, multiple (more than two), conjoined loops have been investigated for the first time by the Applicant. These antennas are formed, as the double loops discussed above, by attaching more than two FW loops end-to-end, linearly, in the same plane. FIG. 5 shows a triple-loop antenna.

A multiple-loop consisting of n loops has n+1 radiators, and the overall gain may be approximated by the power gain of n+1 over that of a dipole. Any number of such loops may be conjoined, although the Applicant has only investigated loops of up to six elements. When fed at the center radiator, or one near the center, the gain and radiation pattern are as expected: broadside gain along the boresight. These multi-loops have unique properties.

Moving from the center radiator feedpoint outwards to other feedpoints at the flanking radiators results in a progressive squint in the radiation pattern. This is related to the shapes of the component rectangles and to their number and is maximal when one of the end radiators is fed. The greater the radiator narrowing, and the greater the compensatory increase in size of the interconnecting transmission line wires, the greater the squint. The more rectangles that are attached to each other, the greater the squint. The squint is related to the progressive phase shift of the antenna currents as they traverse the antenna away from the feed point.

Figure 6:
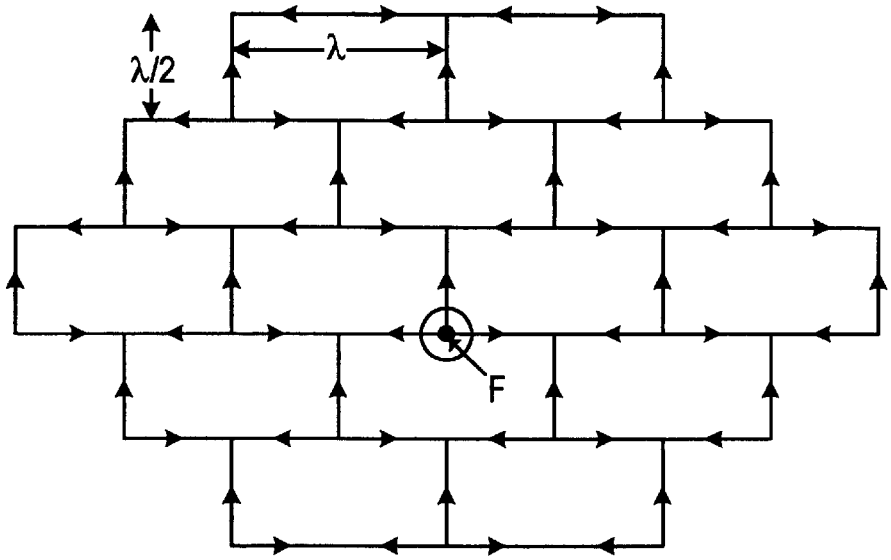
FIG. 6 shows a Grid Flat-Panel Array.

This genre of antennas can be distinguished from other known antennas employing a rectangular structure. The known antennas are grid planar arrays where the rectangles are arranged in overlapping grids of many rectangles in each of their two dimensions. These antennas employ loops of greater than 3 wavelengths in perimeter. FIG. 6 is an illustration of such a Grid Flat-Panel array.

All planar loop antennas exhibit certain threshold effects which are related to their component wire thickness. These effects are related to the exaggeration of the phase shifts discussed above.

Any FW loop antenna, whether single or multiple-loop, has multiple resonances which are related to the dimensions. The first resonance is strongly affected by the wire diameter. The thicker the wire, the greater the negative reactance and the need to increase the loop perimeter in order to resonate the antenna. Or, if the dimensions are unchanged, the effect of progressively increasing the wire diameter is to progressively increase the resonant frequency of the antenna. The second harmonic resonance, due to reactance cancellation at a perimeter of 2 λ, is fairly stable.

A single FW square loop having extremely thick wires (e.g., in the order of 0.03 λ) develops a wide bandwidth. This is because the impedance fluctuations between the primary and secondary resonances are dampened and the intervening range of frequencies show standing wave ratios (SWR) of less than 2:1. The SWR of 2:1 is the commonly used criterion, for transmitting purposes, for a maximum tolerable impedance mismatch between the transmitter and the antenna. The overall bandwidth of such antennas becomes about 2:1 also. The loop perimeter of such an antenna exceeds 1.3 λ.

All of the planar FW rectangular loop antennas, whether single or multi-loop, are severely constrained by the fact that, while their SWR bandwidths are much wider with such thick wires, their gain bandwidths become very narrow. Due to the phase variations related to increased perimeter, their useful radiation—broadside to the plane of the antenna—is not maintained very far above the design frequency. By 30% above the design frequency, they begin to exhibit end-fire radiation along the antenna plane which renders them useless.

The best planar loop antenna found by the Applicant is an asymmetrical double rectangle (ADR) wherein the two rectangles are of unequal size. This had a SWR bandwidth of 2:1 in frequency while maintaining a gain of over 3 dBi (free space) over 65% of that bandwidth.

The antenna of the present invention, the cubically arranged or 3-D rectangle array, is unique and has not been described or investigated until now. Cubical antennas composed of multiple rectangular loops are based on the multi-loop antennas, or planar antennas composed of more than two loops attached linearly. Further investigation into the behavior of these linear planar multi-loops when they are folded back on themselves is unique and is the basis for this application. The resulting antennas are not planar but are three dimensional and exhibit properties which give them advantages over known antennas. These advantages include, but are not limited to: extremely broadband design with SWR bandwidths exceeding 3:1; maintenance of a high and relatively constant gain over the full bandwidth; compactness; selectable feedpoint impedances with low-loss matching techniques; and "stackability" of individual elements to provide more gain over the full bandwidth.

Figure 7:
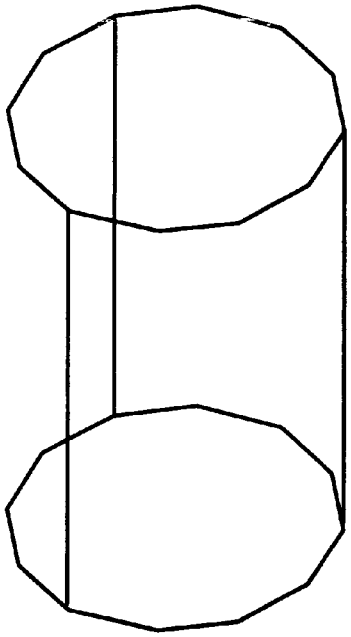
FIG. 7 shows a Cubic Dodecahedron in accordance with another embodiment.

The Applicant has investigated a range of antennas embodying up to 12 contiguous, nominally FW loops with 12 radiators arranged as a dodecahedron. In addition, the effects of feeding the radiators singly, in pairs, or feeding them all were examined. FIG. 4 illustrates the Cubic Triangle and FIG. 7 illustrates the Cubic Dodecahedron.

The antenna structure of the prototype antenna, constructed for a frequency spectrum of 70–170 MHZ, is a "Cubic Triangle" or "3-D triangle." This is the minimum number of loops/radiators which gives rise to a three dimensional structure and consists of three vertical radiators arranged in an equilateral triangle with their transmission line wires connecting them at either end. Each of the component loops is nominally 1 λ in perimeter.

It was determined, from NEC-2 and NEC-4 modeling, that the equilateral triangle yielded the greatest separation among the three radiators, and therefore the greatest gain. Other arrangements, such as placing the three radiators along the circumference of a circle, had less gain due to the fact that the geometry did not allow the maximum separation between them.

The Cubic Triangle consists of a triple linear symmetrical planar rectangular loop array (see FIG. 5) which has been folded back onto itself. It therefore is composed of three rectangular loops with three radiating elements and is shaped as an equilateral triangle when viewed along its long axis.

The following properties were found for the basic Cubic Triangle antenna element. First, the SWR-2 bandwidth ranged from 2:1 with wire thicknesses of 0.005 λ, to over 3:1 with a wire thickness of 0.025 λ. This is not the limit as to bandwidth, but is the limit of the modeling software's capability. Second, depending on the dimensions and the desired feedpoint impedance, the free space gains vary from a minimum of 2.1–2.5 dBi at the lower frequency to 3.2–3.5 dBi at the high frequency limit.

The prototype antenna, vertically polarized, 3 WL above ground and composed of 0.00935 M wires, behaved as modeled over the frequency range of 70–150 MHZ. This wire size was chosen for convenience. It corresponds to the ⅝" OD copper pipe that the antenna was constructed with. The nominal design frequency was 105 MHZ. NEC-2 modeling predicts that the overall bandwidth (SWR) would be 70–210 MHZ if a wire diameter of 0.025 M or 1" is used.

Cubic or 3-D rectangle-based antennas are able to maintain relatively minor excursions in their feedpoint impedance between the first and third harmonic frequencies. This results in the 3:1 bandwidth and distinguishes them from planar linear arrays of rectangles. Their performance, as well as their structure, makes them qualitatively different from planar loop arrays. The stability of the impedance over the full bandwidth is related to the symmetrical mutual impedances between the radiators.

Figure 8:
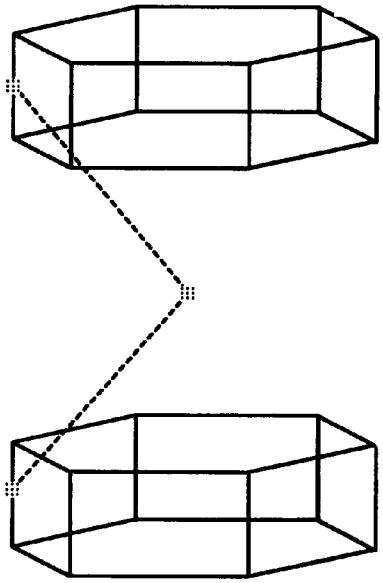
FIG. 8 shows a Cubic Hexagon in accordance with another embodiment.

More complex 3-D structures proved useful. FIG. 8 shows a Cubic Hexagon, which is a two-element array where each element is composed of six radiators in a hexagonal arrangement. This structure proved to be one where the phase relationships resulted in a steerable cardioid radiation pattern with an extremely high front-to-back ratio.

All of the antenna geometries discussed herein have electrically, functionally and symmetrically equivalent structures corresponding to the Electrical Theorem of "Delta-Star Transformation". The antennas are portrayed in this application as composed of rectangles arranged circumferentially around the antenna axis. This is the "delta" equivalent.

Figure 12:
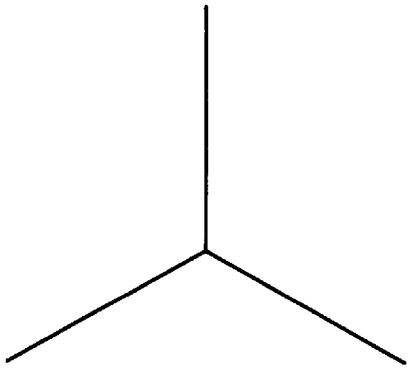
FIG. 12 shows a "star" or radial equivalent of the cubic triangle.

Antennas with identical properties may be designed using the "star" equivalent structure, as shown in FIG. 12. This is done by arranging the rectangles radially about the array axis, keeping the radiators at exactly the same distance from each other as in the "delta" and feeding them in the same manner.

As an example of the equivalent structures, take the cubic triangle in FIG. 4. If one looks down upon axis of the antenna one sees the three sides as forming a "delta" or equilateral triangle. The radiators are at the apexes of the triangle. The equivalent "star" structure is a "Y" or 3-sided "star" when one looks down upon its axis. The radiators are at the tips of the legs of the "Y" or "star".

All of the polygonal arrangements of rectangles have "delta" and "star" equivalents. The use of one or the other is determined solely by structural and manufacturing constraint.

Feed methods will next be discussed. With all of the cubic polygonal antennas, feeding one radiator results in a directive pattern. The major radiation lobe and maximum gain are in the direction of the fed radiator. The forward gain and the magnitude of the rear null can be increased by "stacking" two such antennas. Regardless of polarization, they may be arrayed collinearly and fed in phase.

The two-element Cubic Hexagon array of FIG. 8 achieves the steerable pattern and deep null to the rear by feeding the same radiator in each element in phase.

Single radiator feeding has one major disadvantage. Due to the relative size of the antenna at twice or triple its design frequency, the phase variations result in a pronounced, frequency-dependent squint off the boresight.

Figure 9:
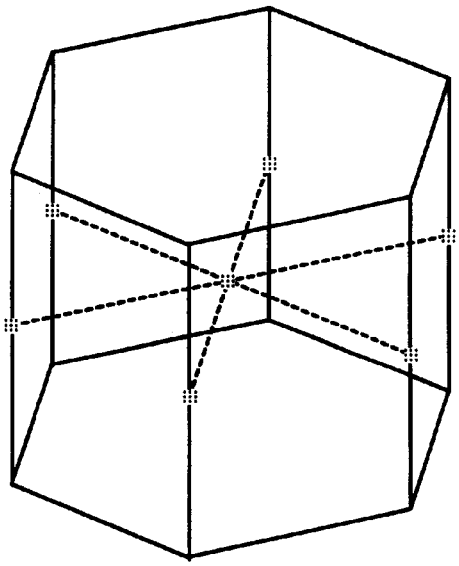
FIG. 9 shows a Cubic Hexagon in accordance with another embodiment where all six radiators are fed from a common feed point.

For omnidirectional gain around the axis of the antenna, the preferred method is to feed all the radiating elements from a common point at the antenna's geometric center. The length of the feedline and its characteristic impedance or Zo were found to be critical in maintaining the full bandwidth. This will be discussed in detail. This method also results in maximum gain along the boresight regardless of frequency. FIG. 9 shows a Cubic Hexagon where all six radiators are fed from a common central feed point.

This antenna behaves predictably from the point of view of feedpoint resistance. The longer the radiating elements, the higher the $R_{in}$. However, from the point of view of gain, it behaves paradoxically as compared to its individual component rectangles. Unlike a planar loop antenna, the gain increases as the radiators are made longer and brought closer together.

The SWR bandwidth is sensitive to the length and the source impedance Zo of the transmission feedlines connecting the radiators' feedpoints. There are two possible ways to feed these antennas. First, one can select a Zo which is equal to the feedpoint impedance of the antenna when only one radiator is fed. Given any wire diameter, there will be an optimum length of feedline which maximizes the bandwidth. This method can result in a feedline which is considerably longer than the distance between the radiator feedpoint and antenna center. Second, the preferred way, is to make all feedlines the shortest possible—the distance from the radiator feedpoints to the common junction point at the antenna center. In this case, the feedpoint impedance and the bandwidth can be controlled by selecting an appropriate Zo for the line.

Although the prototype antenna was constructed with 300 ohm TV ribbon line between the radiators, practical antennas for the higher frequencies would utilize rigid, balanced feedlines with air dielectrics and of the proper Zo to join the radiators at the central feedpoint.

Figure 10:
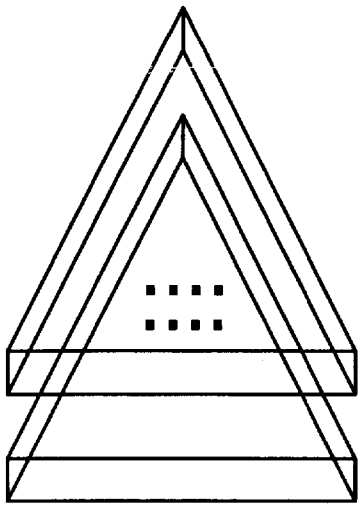
FIG. 10 shows two Cubic Triangle elements oriented in the same manner, resulting in an asymmetrical radiation pattern about the array axis.
Figure 11:
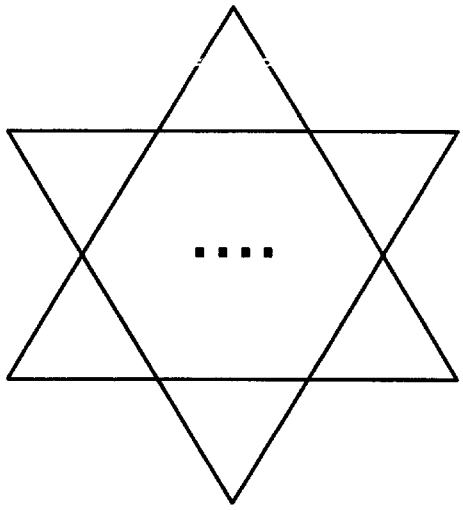
FIG. 11 shows two Cubic Triangle elements rotated with respect to each other so that the apex of one element overlaps the base of the other, resulting in circular radiation patterns.

When Cubic Triangles, or any other Cubic Polygon antenna, are collinearly arrayed, their radiation pattern is affected by the orientation of the elements. When two such elements are oriented in exactly the same manner, the resulting radiation pattern about the array axis is asymmetrical (see FIG. 10). When the array elements are rotated with respect to each other such that the apex of one element overlaps the base of the other, the radiation patterns assume circular patterns (see FIG. 11). Therefore, to achieve uniform radiation patterns about the array axis, it is important to rotate any pair of such elements with respect to each other.

In summary, the present invention relates to a series of antennas with a three dimensional structure based on the folding back onto themselves of planar multi-loop arrays of more than two elements. These planar arrays are also novel and have been investigated exclusively by the Applicant. The 3-D antennas range, at this time, from Cubic Triangles to Cubic Dodecahedrons. There is no limit as to the number of sides that such an antenna may have.

In contrast to planar loop arrays, the Cubics have much wider bandwidths both in impedance and in gain, and behave differently with respect to gain with changes in the relative sizes of their two main dimensions.

The feed method is intrinsic to the performance of this antenna. Single radiator feed results in directivity towards the fed radiator and a relative null off the back. This can be taken advantage of when two such antennas are collinearly arranged and fed in phase. The result is augmented forward gain with a sharp null off to the rear. Such antennas can be electronically rotated. The configuration with the best performance, to date, is the cubic hexagon.

If the goal is to have the widest possible SWR and gain bandwidth, then all the radiators must be fed by transmission lines emanating from a common central point. There is little change in performance with dimensional changes as long as there are also compensatory changes in the source impedance of these feedlines. Moreover, altering these two variables enables a designer to attain any desired feedpoint impedance within a wide range. Such common feeding is essential to having a gain bandwidth which equals or exceeds the SWR bandwidth.

The above invention has been described with specific embodiments, but a person skilled in the art could introduce many variations on these embodiments without departing from the spirit of the disclosure or from the scope of the appended claims. The embodiments are presented for the purpose of illustration only and should not be read as limiting the invention or its application. Therefore, the claims should be interpreted commensurate with the spirit and scope of the invention.

What is claimed is:

1. A three-dimensional antenna array, comprising:

a plurality of rectangular full-wave loops arranged in a three-dimensional array, comprising a plurality of radiators, each radiator having two ends, and a plurality of transmission lines, each transmission line connecting a pair of the radiators through a corresponding end of each connected radiator, wherein each of the plurality of radiators is fed from a common feedpoint substantially at a geometric center of the three-dimensional antenna array.

2. The three-dimensional antenna array as claimed in claim 1, wherein the radiators and the transmission lines are orthogonal.

3. A three-dimensional antenna arranged as a cubic triangle, comprising:

three contiguous full-wave loops arranged vertically to form the cubic triangle, comprising three radiators, each radiator having two ends, and a plurality of transmission lines, each transmission line connecting a corresponding pair of the radiators through a corresponding end of each radiator in the connected pair of radiators; and wherein each of the three radiators is fed from a common feedpoint substantially at a geometric center of the cubic triangle.

4. The three-dimensional antenna as claimed in claim 3, wherein the radiators and the transmission lines are orthogonal.

5. A three-dimensional antenna array arranged as a cubic hexagon, comprising:

a first element having a first group of six radiators arranged in a hexagonal arrangement, and a first plurality of transmission lines, wherein each radiator in the first group of six radiators has two ends, and each transmission line in the first plurality of transmission lines connects a corresponding pair of radiators in the first group of six radiators through a corresponding end of each radiator in the connected pair of radiators; and a second element spaced apart from the first element and having a second group of six radiators arranged in a hexagonal arrangement and a second plurality of transmission lines, wherein each radiator in the second group of six radiators has two ends, and each transmission line in the second plurality of transmission lines connects a corresponding pair of radiators in the second group of six radiators through a corresponding end of each radiator in the connected pair of radiators, wherein a corresponding radiator in each element is fed in phase.

6. The three-dimensional antenna array as claimed in claim 5, wherein the radiators and the transmission lines are orthogonal.

7. A three-dimensional antenna arranged as a cubic hexagon, comprising:

a group of six radiators arranged in a hexagonal arrangement, each radiator having two ends; and a plurality of transmission lines, each transmission line connecting a corresponding pair of radiators in the group of six radiators through a corresponding end of each radiator in the connected pair of radiators;

wherein each radiator has a corresponding feedline extending to a common feedpoint substantially at a geometric center of the cubic hexagon.

8. The three-dimensional antenna as claimed in claim 7, wherein the radiators and the transmission lines are orthogonal.

9. An antenna, comprising a three-dimensional arrangement of full-wavelength loops having a plurality of radiators, each radiator being fed from a common feedpoint substantially at a geometric center of the three-dimensional arrangement.

10. The antenna as claimed in claim 9, wherein the radiators and the transmission lines are orthogonal.

* * * * *